United States Patent [19]

Lau

[11] 4,054,944

[45] Oct. 18, 1977

[54] FINGER OPERATED SWITCHING DEVICE

[75] Inventor: Edward H. Lau, Old Westbury, N.Y.

[73] Assignee: Redactron Corporation, Hauppauge, N.Y.

[21] Appl. No.: 653,236

[22] Filed: Jan. 28, 1976

Related U.S. Application Data

[63] Continuation-in-part of Ser. No. 541,943, Jan. 17, 1975, abandoned.

[51] Int. Cl.[2] ..... H01H 51/27

[52] U.S. Cl. ..... 335/207; 200/5 E; 200/67 F

[58] Field of Search ..... 335/207, 206, 205; 200/67 F, 5 E, 50 C, 159 B; 340/365 L

[56] References Cited

U.S. PATENT DOCUMENTS

| | | | |
|---|---|---|---|
| 3,268,673 | 8/1966 | Bilek | 200/5 E |
| 3,588,766 | 6/1971 | Baermann | 335/207 |
| 3,617,661 | 1/1971 | Bloomfield et al. | 200/5 E |
| 3,815,066 | 6/1974 | Vinal | 335/207 |

*Primary Examiner*—Harold Broome

*Attorney, Agent, or Firm*—Camil P. Spiecens

[57] ABSTRACT

A finger operated switching device includes a key assemblage having a key and a key magnet which moves relative to a biasing magnet wherein the magnets are so dimensioned and mutually positioned so that the key assemblage is biased to a retracted position and when the key assemblage is pushed to an extended position the force required first increases to a peak and then rapidly decreases.

17 Claims, 10 Drawing Figures

FIG. 1A
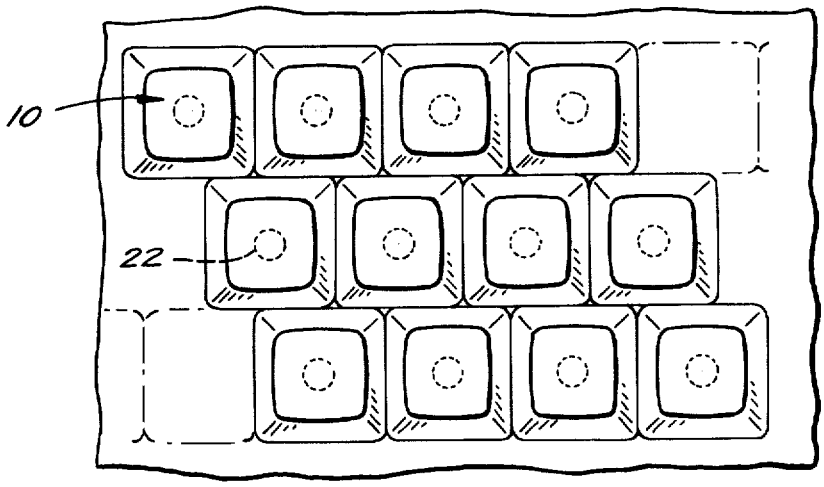
FIG. 1B
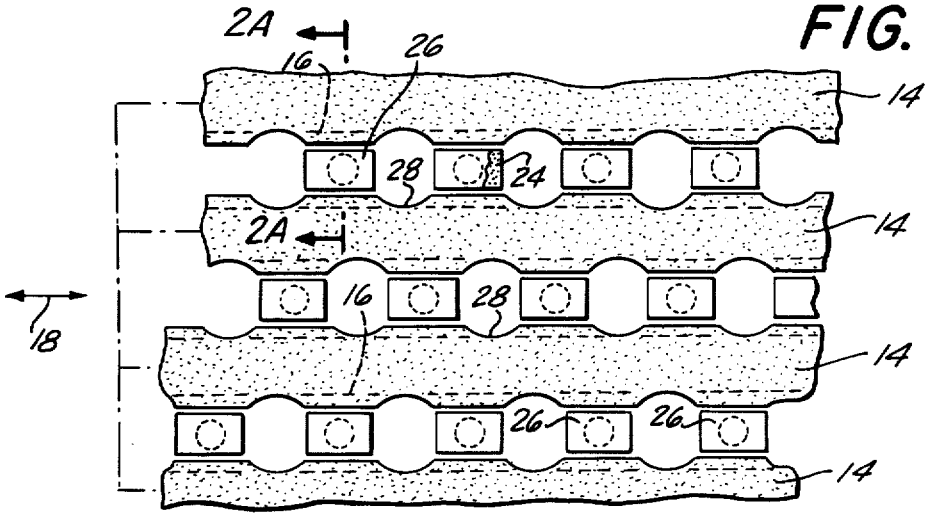
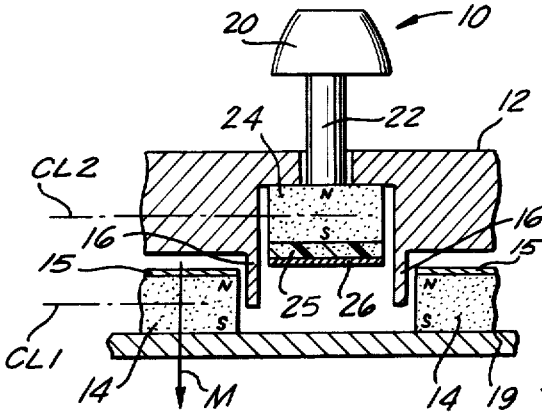
FIG. 2A
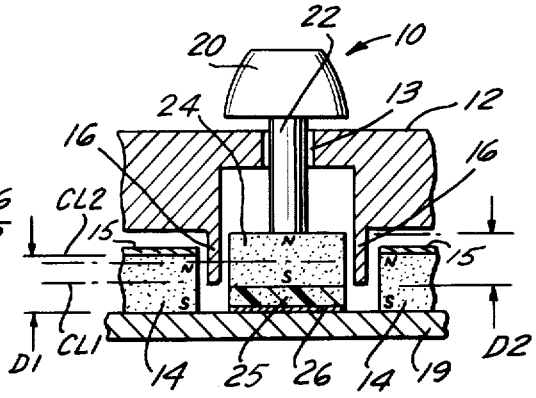
FIG. 2B

FIG. 3A
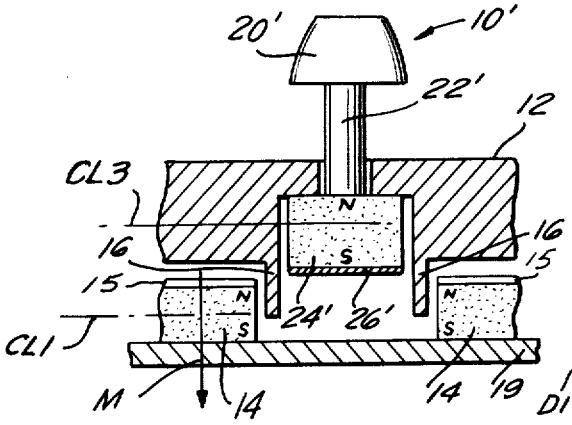
FIG. 3B
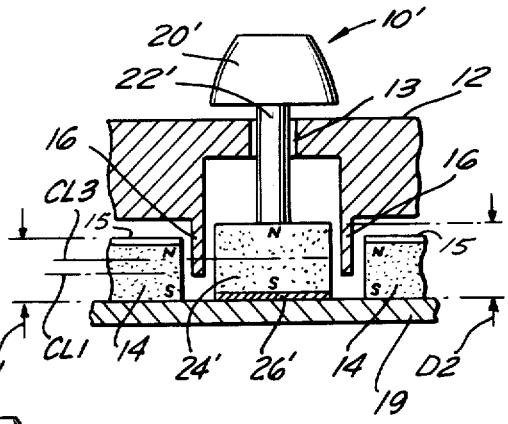
FIG. 4
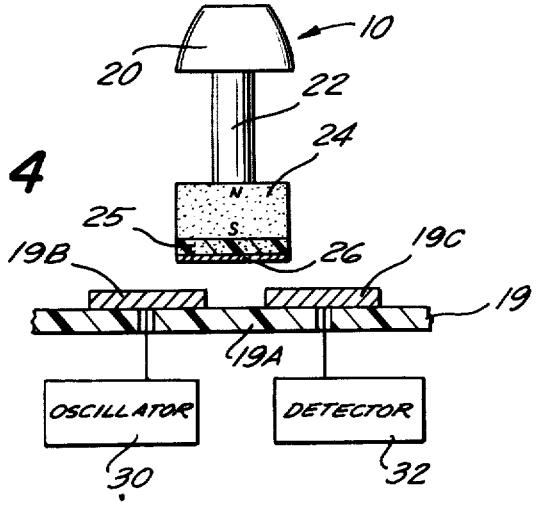
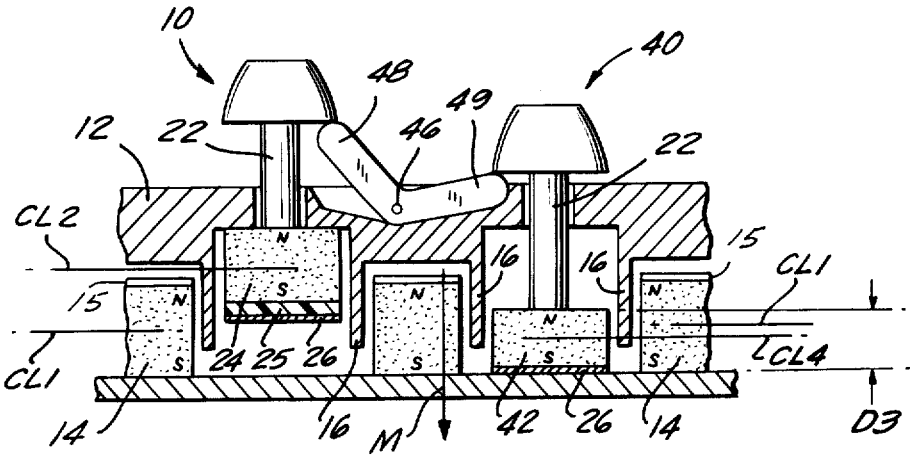
FIG. 5

FIG. 6
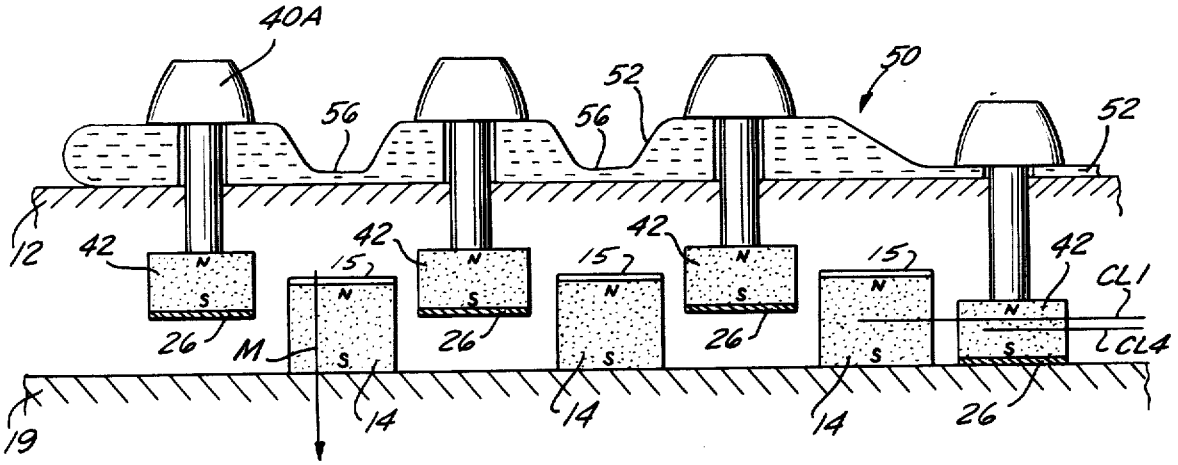
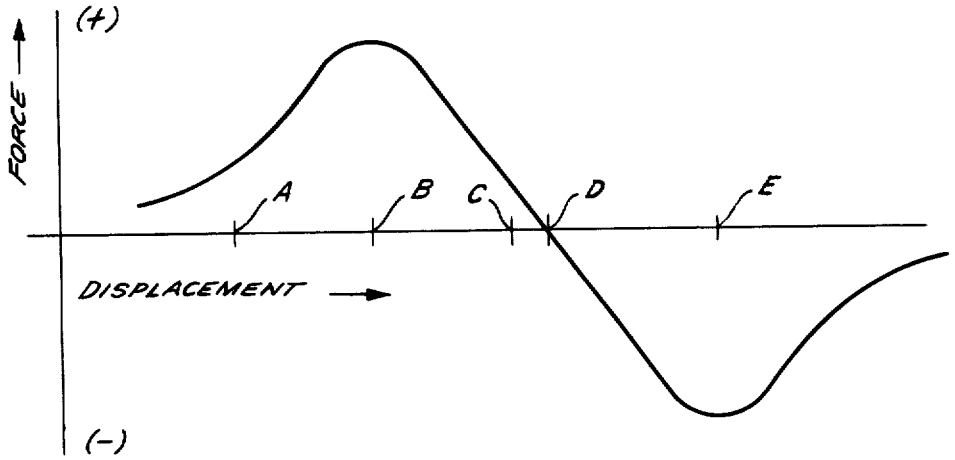
FIG. 7

FINGER OPERATED SWITCHING DEVICE

CROSS-REFERENCE TO RELATED APPLICATIONS

This application is a continuation-in-part of my copending application Ser. No. 541,943, filed Jan. 17, 1975, now abandoned.

BACKGROUND OF THE INVENTION

This invention pertains to finger operated switching devices and more particularly to such devices which utilize magnets to provide the restoring forces after operation of the switching device.

Finger operated switching devices have many uses such as in key-operated office machines, entry tabulators, key punchers and calculators, keyboards in electric typewriters, word processors, printing and typesetting machines and keysets in telephones. In each of these applications a key assemblage is momentarily depressed by a finger from a home position to an active position to close a circuit, and upon release of the finger the key assemblage is restored to its home position and the circuit opens. In many of the devices, mechanical biasing means biased the key assemblage to the home position so that upon release the key assemblage automatically leaves the active position. It is known to use springs and weights for the biasing means. However, such solutions only add further complications. First they require extra moving parts and secondly they introduce an undesirable force vs. displacement characteristic to the key assemblage. In particular such means have a characteristic where the opposing force monotonically increases with displacement. This monotonic increase creates two problems. First, because the restoring force increases with increasing displacement, it is less likely that the necessary throw or travel of the key assemblage for the desired switching function will occur for each user. Secondly, it has been found that users of typewriters or similar devices have become accustomed to a particular force vs. displacement characteristic which generally increases to a maximum opposing force for an intermediate displacement and thereafter rapidly falls off to a lesser opposing force. This phenomenon is known as tactile feel or snap action. If the operator does not sense such tactile feel, his physiological feedback is disturbed and keystroking is slowed down and/or becomes erratic and unreliable. There have been many proposals to simulate tactile feel by adding mechanical means such as toggle devices. However, such devices merely add complexity and more moving parts to the devices.

Another proposal is shown in U.S. Pat. No. 3,815,006 wherein magnetic means are used to provide the tactile feel. However, the device shown therein uses moving sets of magnets to provide the tactile feel or over-center-or snap action, and other magnets or springs to provide the means for the automatic return of the key. Again while tactile feel is provided it is at the expense of simplicity and restriction to the use of single keys as opposed the arrays of keys.

It is accordingly a general object of the invention to provide an improved finger operated switching device having a minimum number of moving parts.

It is a further object of the invention to provide such a device wherein the biasing or restoring forces are provided by non-mechanical means and simulate the desired tactile feel.

In an attempt to make a finger operated switching device requiring a minimum of moving parts it is necessary to consider the electrical switch portion per se. Generally the switch portion comprises contact sets which are mechanically engaged or disengaged in response to the travel of the key assemblage. While such contact sets perform adequately they introduce parts which are subject to wear.

It is accordingly an object of a feature of the invention to provide an electrical switch portion which does not have parts which are subject to contact wear.

Finally, with some switching devices it is desirable to have key assemblages which are locked in an activated position even after release of the finger, and are only released at some later time by the operation of another key assemblage or other device. The most immediate examples are the shift lock key of a typewriter and the extension and line selection buttons of telephone handsets.

It is accordingly an object of and a further feature of the invention to provide such a switching device which is extremely simple and less complex than previously available devices.

Other objects, features and advantages of the invention will be apparent from the following detailed description when read with the accompanying drawings, which show by way of example and not limitation, the presently preferred embodiment of the invention.

In the drawing:

FIG. 1A shows a top plan view of keyboard utilizing the finger operated switching devices of the invention;

FIG. 1B shows a bottom plan view of the keyboard of FIG. 1A with a printed circuit plate removed;

FIG. 2A shows a sectional view one embodiment of the keyboard with a key assemblage in the retracted or home position;

FIG. 2B is a view similar to FIG. 2A with the key assemblage in the extended or active position;

FIG. 3A shows a sectional view of another embodiment of the keyboard with a key assemblage in the retracted or home position;

FIG. 3B shows a view similar to FIG. 3A with the key assemblage in the extended or active position;

FIG. 4 is a schematic view of the electric circuit controlled by a key assemblage in accordance with the invention;

FIG. 5 is a sectional view of a variation of the invention for self latching key assemblage;

FIG. 6 is a sectional view of another embodiment of self latching key assemblages; and FIG. 7 is a force displacement curve of the invention.

In FIGS. 1 and 2 a portion of a keyboard is shown comprising a plurality of key assemblages 10 supported in rows through the aid of frame 12 which also supports and guides via flanges 16 a plurality of biasing magnets 14. The biasing magnets are ganged to move along their major axes in the directions indicated by arrow 18, which is orthogonal to their magnetic axis indicated by arrow M of FIG. 2. Supported by means not shown is a printed circuit plate 19 whose function will hereinafter become apparent. The tops of the biasing magnets are preferably covered with a slab of iron or other low reluctance material which acts as a keeper or flux concentrator.

A key assemblage 10 according to the preferred embodiment of the invention comprises a key 20 at one end of a keystem 22 which passes through bearing 13 of frame 12. Fixed to the other end of keystem 22 is a key magnet 24 whose bottom surface (as viewed in FIGS. 2A and 2B) carries a spacer 25 to which is affixed a lamina 26 of electrically conductive material whose bottom face is covered with electrical insulation.

Attention is now directed to the magnetic relationships between the biasing and key magnets. Each biasing magnet 14 is polarized along the axis indicated by the arrow M with the N and S poles separated by a distance D1, and has a magnetic centerline CL1. Each of the key magnets 24 is similarly polarized along a line parallel to axis M. However, the N and S poles of key magnets 24 are separated by a distance D2 and has a magnetic centerline CL2. It should be noted that the bearing 13 guides keystem 22 so that movement of the key assemblage 10 results in the associated key magnetic 24 moving along a path which is opposite a biasing magnet 14 and which is parallel to axis M.

As shown in FIG. 2A when key assemblage 10 is in the retracted position the magnetic centerline CL2 is above the magnetic centerline CL1. The forces between the magnets is dependent on the interaction of the flux lines of each of the biasing and keystem magnets with each other since they do not have a common low reluctance path. Before the key 20 is depressed the force is that for the displacement A in FIG. 7. Now, as key 20 is depressed, the key magnet 24 moves downward and the N poles approach each other as do the S poles, with increased interaction of the fields, resulting in an increasingly higher repelling force. The repelling forces increase until finally a point B is reached in the travel when the repelling force along axis M reaches a maximum. After this maximum point the repelling force along axis M falls off to a lower value when the key assemblage 10 reaches its other end position as shown in FIG. 2B and point C of FIG. 7. Thus, the typical operating range of key 20 is between points A and C. At point C magnetic centerlines CL1 and CL2 are closer together but centerline CL2 is still above centerline CL1.

A key assemblage 10' according to another embodiment of the invention comprises a key 20' at one end of a keystem 22' which passes through bearing 13 of frame 12. Fixed to the other end of keystem 22' is a key magnet 24' whose bottom surface (as viewed in FIGS. 3A and 3B) carries a lamina 26' or electrically conductive material.

Attention is now directed to the magnetic relationships between the biasing and key magnets. Each biasing magnet 14 is polarized along the axis indicated by the arrow M with the N and S poles separated by a distance D1 and has a magnetic centerline CL1. Each of the key magnets 24 is similarly polarized along a line parallel to axis M. However, the N and S poles of key magnets 24 are separated by a distance D2' and has a magnetic centerline CL3. It should be noted that the bearing 13 guides keystem 22' so that movement of the key assemblage 10' results in the associated key magnet 24' moving along a path which is opposite a biasing magnet 14 and which is parallel to axis M.

As shown in FIG. 3A when key assemblage 10' is in the retracted position the magnetic centerline CL3 is above the magnetic centerline CL1. Now, as key 20' is depressed, the key magnet 24' moves downward the respective fluxes of the magnets interact resulting in an increasing higher force. The repelling forces increase until finally a point is reached in the travel when the repelling force along axis M reaches a maximum. After this maximum point the repelling force along axis M rapidly falls off to a lower value when the key assemblage 10' reaches its other end position as shown in FIG. 3B. It should be noted that the magnet centerline CL3 is still above the magnet centerline CL1. Thus, when pressure is released from key 20' the key assemblage 10' will automatically return to the position shown in FIG. 3A.

With respect to the embodiment shown in FIG. 2 the constraints placed on the final position of the centerline CL2 is provided by spacer 25, while for the embodiment shown in FIG. 3 such constraint is provided by key magnet 24' being thicker than biasing magnet 14.

This force displacement profile, i.e., an increasing resistance to a maximum value to and thereafter a rapid falling off as shown between points A and C of FIG. 7 has been found highly desirable for finger operated keys. However, it has also been found that particularly with typewriter keyboards, typists have their own preferences as to keyboard feel. This phenomenon known as touch control demands that the keyboard be provided with the facility to change the repelling forces. Touch control can be accomplished by varying the spacing between the key and biasing magnets. One way would be to controllably insert magnetic shielding between the magnets or laterally separate the magnets. However, it has been found that an especially elegant and simpler way to control the force is to vary the air gap between the magnets. Accordingly, the biasing magnets 14 are provided with regularly spaced arcuate cut-outs 28. It should be apparent that as the biasing magnet is, say, moved to the left the gap between it and the key magnets increases, decreasing the overall repelling forces. While arcuate cut-outs are shown, other contours such as a sawtooth or ramp can be used. By ganging all the biasing magnets 14, they can be simultaneously moved to simplify the touch control.

The actuation of the key assemblages 10 and 10' is used to close electrical circuits. For example, in FIG. 4 there is shown the key assemblage 10' with an exaggerated lamina 26 of conductive material covered with an insulated coating opposite printed circuit plate 19 having substrate 19A in which are printed pads 19B and 19C of conductive material. Pad 19B is connected to signal oscillator 30 and pad 19C is connected to signal detector 32. Now, when key assemblage 10 is depressed toward plate 19 the A.C. signal is capacitatively coupled from oscillator 30 and pad 19B via lamina 26, the pad 19C and detector 32. When the key assemblage is retracted the coupling is removed. Thus, the movement of lamina 26 controls the transfer of signals in the electrical circuit between oscillator 30 and detector 32. Note with some magnets the lamina 26 may not be needed since the magnet per se may supply the coupling.

Sometimes it is desirable to have a key assemblage that can latch. For example, on a typewriter keyboard there is a shift key and a shift lock key. When the shift lock key is depressed to obtain upper case characters, it remains depressed even after the removal of pressure and can only be released when the key is depressed.

In FIG. 5 there is shown such a configuration utilizing the invention wherein key assemblage 10 is equivalent to the shift key and key assemblage 40 is equivalent to the shift lock key of a typewriter. Since many of the components are the same as those previously described, like components will have the same reference numerals and only the differences will be described. In particular the only differences in key assemblage 40 is that its key magnet 42 a lamina configuration is "thinner" than biasing magnet 14, i.e., centerline CL4 is allowed to go below centerline CL1 in the depressed position. Thus, when key assemblage 40 is in the position opposite to that shown in FIG. 5, i.e., similar to that of key assemblage 10, the relations of the poles of the key magnet 42 and biasing magnet 14 are the same as previously described for key assemblage 10 in such retracted position. In addition the magnetic centerline CL4 is higher than the magnetic centerline CL1. The upward repelling force passes through zero at point D of FIG. 7 to become negative, i.e., there is a downward force which increases to point E holding the key assemblage down even after finger pressure is removed because the magnetic centerline CL4 moves below the magnetic centerline CL1.

A study of FIGS. 5 and 7 will make this phenomenon apparent. When key assemblage 40 is in the position shown therein, there is a downward component of force therefrom along axis M.

Thus, once key assemblage 40 is depressed it will remain depressed until restored by some external means. The restoration can be accomplished by means of a lever pivotally mounted in frame 12 at point 46 with one arm 48 in the path of travel of the key 20 of key assemblage 10 and another arm 49 in the path of travel of the key 20 of key assemblage 40.

Therefore, when key assemblage 40 is in the latched position as shown, it can be restored merely by depressing key assemblage 10.

A variation of the restoring scheme is shown in FIG. 6 where the key assemblages 40A to D are the same as the key assemblages 40 in FIG. 5. However, instead of using the mechanical lever mechanism of FIG. 5 a fluidic, i.e., hydraulic or pheumatic mechanism is used in the form of a closed pliable fluidic chamber 50 having expansion regions 52 connected by passages 56. Thus, to restore key assemblage 40D it is only necessary to depress key assemblage 40C. More specifically, FIG. 6 shows a "one out of N" keyboard wherein the depression of any key will cause its key assemblage to lock down and release any other locked down key assemblages. While the fluidic mechanism has been shown as a pliable fluidic chamber, it is possible to use a manifold connected to a plurality of piston mechanisms, each below a different key.

There has been shown an improved finger operating switching device which by using particular configurations of cooperaing magnets provides tactile-feel-key-operated switches having a minimum of mechanical and electrical parts.

There will now be obvious to those skilled in the art many modifications and variations satisfying many or all of the objects of the invention but which do not depart from the spirit thereof as defined by the appended claims.

For example, the shapes of the magnets can be modified from parallellpipeds to various truncated shapes or further kelpers can be used to provide different force displacement profiles.

In addition, the relative strengths and thicknesses (heights) of the biasing and key magnets to each other may be varied to provide different force displacement curves subject to the following conditions. For a non latching key assemblage the centerline of the key magnet must always be above the centerline of the biasing magnet even in the fully depressed position. This can be accomplished by controlling the thickness of spacer 25 or shimming the biasing magnet up from plate 19. For a latching key assemblage, somewhere in the travel of the centerline of the key magnet must move below the centerline of the biasing magnet.

I claim:

1. A finger operated switching device comprising a biasing magnet having a first pole with a first magnetic polarity and a second pole with a second and opposite magnetic polarity, said poles being spaced from each other along a given axis whereby a first magnetic centerline is established within the said biasing magnet; a key assemblage, said key assemblage having a key and a key magnet connected thereto, said key magnet having a first pole with said first polarity and a second pole with said second polarity, said poles being spaced from each other along a first line parallel to said given axis whereby a second magnetic centerline is established within said key magnet, said biasing magnet and said key magnet being magnetically polarized in the same direction; guiding means for guiding said key assemblage to move along a path adjacent and opposite said biasing magnet and parallel to said given axis between a first end position wherein the second magnetic centerline is above and displaced from the first magnetic centerline by a first distance and a second end position wherein the second magnetic centerline is above and displaced from the first magnetic centerline by a second and shorter distance; electrical circuit means which is switchable between transmissive and non-transmissive states; and controlling means connected to said key assemblage for changing the state of said electrical circuit means as said key assemblage is moved from one to the other of the end positions of said first path.

2. The finger operated switching device of claim 1 wherein said biasing magnet is unmovable in a direction parallel to said given axis.

3. The finger operated switching device of claim 1 wherein the first and second poles of said biasing magnet are spaced from each other by a distance D1 which is different from a distance D2 by which the first and second poles of said key magnet are spaced from each other.

4. The finger operated switching device of claim 2 wherein said distance D1 is greater than said distance D2.

5. The finger operated switching device of claim 2 wherein said distance D2 is greater than said distance D1.

6. The finger operated switching device of claim 1 wherein said conductive means comprises a lamina of conductive material fixed to said key magnet.

7. The finger operated switching of claim 1 further comprising adjusting means for changing the dimensions of the air gap between said key and biasing magnets.

8. The finger operated switching device of claim 7 wherein said conductive means comprises a lamina of conductive material fixed to said key magnet.

9. The finger operated switch of claim 1 further comprising a laminar spacer of elastomeric material at the bottom of said key magnet.

10. A finger operated switching device comprising: an elongated biasing magnet having a first pole with a first magnetic polarity and a second pole with a second and opposite magnetic polarity, said poles being spaced from each other along a give axis whereby a first magnetic centerline is established with said biasing magnet; a first key assemblage, said first key assemblage having a key and a key magnet connected thereto, said key magnet having a first pole with said first polarity and a second pole with said second polarity, said poles being spaced from each other along a first line parallel to said given axis whereby a second magnetic centerline is established within said key magnet; first guiding means for guiding said first key assemblage to move along a first path adjacent said biasing magnet and parallel to said given axis between a first end position wherein the second magnetic centerline is above and displaced by a first distance from the first magnetic centerline and a second end position wherein the second magnetic centerline is above and displaced by a second and shorter distance from said magnetic centerline; first electrical circuit means which is switchable between transmissive and non-transmissive states; first controlling means connected to said first key assemblage for changing the state of the said first electrical circuit means as said first key assemblage moves from one to the other of the end positions of said first path; a second key assemblage which is the same as said first key assemblage; second guiding means for guiding said second key assemblage to move along a second path adjacent said biasing magnet and parallel to said given axis between a first end position wherein the magnetic centerline of said key magnet of said second key assemblage is above and displaced by said first distance from the first magnetic centerline, a second end position wherein the magnetic centerline assemblage is above and displaced by said second distance from the first magnetic centerline; second electrical circuit means switchable between transmissive and non-transmissive states; second controlling means connected to said second key assemblage for changing the state of said second electrical circuit means as said second key assemblage moves from one to the other of the end positions of said second path; and means for simultaneously adjusting the magnet forces between said biasing magnet and said key magnets.

11. The finger operated switching device of claim 10 wherein said biasing magnet has a major axis which is perpendicular to said given axis, and is disposed opposite the key magnets of said key assemblages, the portions of said biasing magnet in the region of said key magnets having a width dimension transverse to said major axis which varies as a function of position along said major axis and said adjusting means comprises means for guiding said biasing magnet along said major axis whereby the air gap between said biasing magnet and key magnets is controllably variable.

12. The finger operated switch device of claim 11 wherein the first and second poles of said biasing magnet are spaced from each other by distance D1 which is different from the distance D2 by which the first and second poles of said key magnets are spaced from each other.

13. The finger operated switching device of claim 12 wherein said distance D1 is greater than said distance D2.

14. The finger operated switching device of claim 12 wherein said distance D2 is greater than said distance D1.

15. A finger operated switching device comprising a biasing magnet having a first pole with a first magnet polarity and a second pole with a second and opposite magnetic polarity, said poles being spaced from each other along a given axis whereby a first magnetic centerline is established within the said biasing magnet; a first key assemblage, said first key assemblage having a key and a key magnet connected thereto, said key magnet having a first pole with said first polarity and a second pole with said second polarity, said poles being spaced from each other along a first line parallel to said given axis whereby a second magnetic centerline is established within said key magnet, said biasing magnet and said key magnet being magnetically polarized in the same direction; first guiding means for guiding said first key assemblage to move along a path adjacent said biasing magnet and parallel to said given axis between a first end position wherein the second magnetic centerline is above and displaced from the first magnetic centerline by a first distance and a second end position wherein the second magnetic centerline is below and displaced from the first magnetic centerline; electrical circuit means which is switchable between transmissive and non-transmissive states; controlling means connected to said first key assemblage for changing the state of said electrical circuit means as said key assemblage is moved from one to the other of the end positions of said first path; and finger operated restoring means for selectively returning said key assemblage from said second end position to said first end position.

16. The finger operated switching device of claim 15 further comprising a second key assemblage which is the same as said first key assemblage, second guiding means for guiding said second key assemblage to move along a second path adjacent the biasing magnet and parallel to said given axis between a first end position wherein the magnetic centerline of the key magnet is above the magnetic centerline of the biasing magnet and a second end point wherein the magnetic centerline of the key magnet is below the magnetic centerline of the biasing magnet; second electrical circuit means which is switchable between conductive and non conductive states, a second conductive means connected to said second key assemblage for changing the state of said second electrical circuit means as said second key assemblage moves from one to the other of the end positions of the second path; and restoring means contacting said key assemblages for urging one of said key assemblages from the second end position to the first end position of its associated path when the other of said key assemblages is moved from the first end position to the second end position of its associated path.

17. The finger operated switching device of claim 16 wherein said restoring means includes a hydraulic chamber adjacent the first end positions of said paths.

* * * * *